United States Patent [19]

Prosser et al.

[11] Patent Number: 4,993,708

[45] Date of Patent: Feb. 19, 1991

[54] BATTING TEE

[76] Inventors: William Prosser, 1966 Mears Pkwy., Margate, Fla. 33063; Preston Douglas, 8400 SW. 20th St., North Lauderdale, Fla. 33068.

[21] Appl. No.: 320,913

[22] Filed: Mar. 7, 1989

Related U.S. Application Data

[63] Continuation of Ser. No. 935,730, Nov. 28, 1986, abandoned.

[51] Int. Cl.[5] ..... A63B 69/00

[52] U.S. Cl. ..... 273/26 R

[58] Field of Search ..... 273/184 B, 198, 185 C, 273/200 R, 196, 197 R, 197 A, 26, 207, 26 R, 29 A, 200; 272/76, 77, 78

[56] References Cited

U.S. PATENT DOCUMENTS

| | | | |
|---|---|---|---|
| 2,146,736 | 2/1939 | Hammont et al. | 273/207 |
| 2,470,817 | 5/1949 | Hendricks | 273/207 |
| 2,839,304 | 6/1958 | Lerick | 273/207 |
| 3,489,411 | 1/1970 | Morelli et al. | 273/26 R |
| 4,524,974 | 6/1985 | Matsuura | 273/207 |
| 4,609,197 | 9/1986 | Vodin | 273/200 R |
| 4,610,451 | 9/1986 | Keys | 273/207 |

FOREIGN PATENT DOCUMENTS

| | | | |
|---|---|---|---|
| 781287 | 2/1935 | France | 273/207 |
| 362433 | of 1906 | United Kingdom | 272/78 |
| 305406 | 2/1929 | United Kingdom | 273/207 |
| 431204 | 7/1935 | United Kingdom | 273/207 |

*Primary Examiner*—Theatrice Brown

*Attorney, Agent, or Firm*—Malin, Haley, McHale, DiMaggio & Crosby

[57] ABSTRACT

The present invention is comprised of a tee ball stand which simulates actual hitting conditions by employing a generally vertical elongated stand having a base portion supporting a separable resilient ball support member at its upper end portion which pivots about its lower portion upon being impacted by a bat and is urged back to its vertical at rest position by a cord and spring arrangement coaxially connected within said base portion.

11 Claims, 2 Drawing Sheets

BATTING TEE

This is a continuation application of copending U.S. patent application Ser. No. 06/935,730, filed Nov. 28, 1986 (now abandoned).

BACKGROUND OF THE INVENTION

1. Field of the Invention

The present invention relates to sporting and gaming equipment generally and more specifically to a tee ball stand which simulates actual hitting conditions by employing a generally vertical elongated stand having a base portion supporting a separable resilient ball support member, which ball support member pivots about its lower portion upon being impacted by a bat and is urged back to its vertical at rest position by a biasing means arranged coaxially within said base portion.

2. Prior Art

Baseball batting stands have been disclosed in the past having resilient upper ball rest portions and self-righting features. Those of material interest are found in U.S. Pat. Nos. 4,383,686 and 4,445,685 to Cardieri, in U.S. Pat. No. 3,183,000 to Dix and in U.S. Pat. No. 3,877,697.

Inevitably, a batter using a tee ball batting stand will, when desirous of impacting his bat cleanly upon a ball atop the stand, strike a blow at least partly upon the stand itself. For this reason, stands have been proposed having resilient ball rest portions. To dissipate the unusually large forces imparted to these stands by a high speed swing, shock dissipation means have been used. For instance, U.S. Pat. No. 3,183,000 to Dix has a vertical post which is resilient through its entire length, allowing the post to bend into a 180° U-shape when struck, and thereafter right itself. However, the post of Dix, upon springing back to the vertical, will swing back and forth until reaching a motionless state, which swinging motion presents a danger to anyone nearby due to the great forces involved.

SUMMARY OF THE INVENTION

The T-ball stand of the present invention is comprised of a generally vertical elongated stand having a base portion supporting a telescoping interconnecting member slidably disposed therein which in turn is detachably connected to an upper resilient separable or break-away ball support member. The interconnecting member allows the height of the ball support member to be adjusted to each individual user by sliding said interconnecting member relative to said base member thereby raising or lowering the position of said ball support member. The break-away ball support member becomes completely detached from said interconnecting member when struck by a bat so as to dissipate the great forces imparted thereto and is thereafter urged back to an upright position atop said interconnecting member by return means.

In particular, the ball support member is a generally cylindrical sleeve and is made of a resilient material which is yieldable when struck by a bat so as to dissipate contact forces. Rigidly connected to said ball support member is a ball support core which has a lower surface portion in the shape of a partial cone having a centrally located aperture through which passes a nylon cord. Rigidly, but adjustably, fastened to said ball support core is said nylon cord which passes through said aperture and extends downwardly of said core and is fixed to a spring biasing means connected to said interconnecting member.

The interconnecting member is also cylindrical in shape and is slidable within the base member or ground engaging support member. Connected to the uppermost end of said interconnecting member is a generally cylindrical ball support core seat having its upper surface shaped as the inverse of the lower surface of the ball support core to allow for free sliding movement of each surface relative to the other when said ball support member is caused to break-away in a manner to be set forth hereinafter. Said seat surface surrounds an aperture therein coaxial with a corresponding aperture in said ball support seat the to allow the cord to pass therethrough. Said ball support core seat has connected to its lowermost periphery a resilient shock absorbing member means for dissipating the forces imparted to the stand by a batter which acts to decelerate the break-away movement of said ball rest core. The shock absorbing member is preferably surrounded by a helical compression spring to add to the dissipative strength thereof.

The base member has friction bearings connected to its inner surface to allow the telescoping action of the interconnecting member to be smooth and to further prevent the rattling and vibration that is common to most T-ball stands. Means connected to the base member are provided for releasably securing said interconnecting member at an infinite number of positions selected by the user. Removable ground piercing means may be provided for engaging the T-ball stand into the ground for use out of doors. Said ground piercing means may be replaced by a horizontal platform or the like for supporting the T-ball stand during indoor use.

Said nylon cord is arranged coaxially with respect to the above mentioned elements so that it passes from its point of connection on the ball support core downwardly through the aperture in said lower core surface, through the aperture in said ball support seat member, through said shock absorbing member means, said member and into integral connection with a washer like annular member, which is operably connected to said shock absorbing member means.

In use, the batter places a ball atop the resilient ball support member and strikes it. Should the bat contact the support member it will pivot about its lower end while its lower end is generally held in place by said cord. The pivoting movement of said ball support member imposes a tension on the cord and biasing means arrangement, eliciting a restoring force from the biasing means through said annular member to said cord, thereby causing the ball support member to return quickly to its upright position. Safety cable means connected between said ball support member and said interconnecting member may be provided to prevent said ball support member from flying away at high speed in the event that the cord breaks. construction and therefore long lasting.

Another object of the present invention is the provision of an adjustable, self-righting batting or hitting stand.

A further object of the present invention is the provision of a batting or hitting stand having shock dispersion capabilities which enhance the durability and length of service of the device.

A still further object of the present invention is the provision of a batting or hitting stand with a separable, resilient ball support means that is self-righting.

A further object of the present invention is to provide a batting tee stand that can be rebuilt instead of thrown away.

A further object of the present invention is to provide a batting stand that dissipates forces imparted thereto so as to maintain the functional integrity and useful life of the apparatus.

In accordance with these and other objects which will become apparent hereinafter, the instant invention will now be described in detail with particular reference to the accompanying drawings.

DETAILED DESCRIPTION OF THE PREFERRED EMBODIMENT

Figure 1:
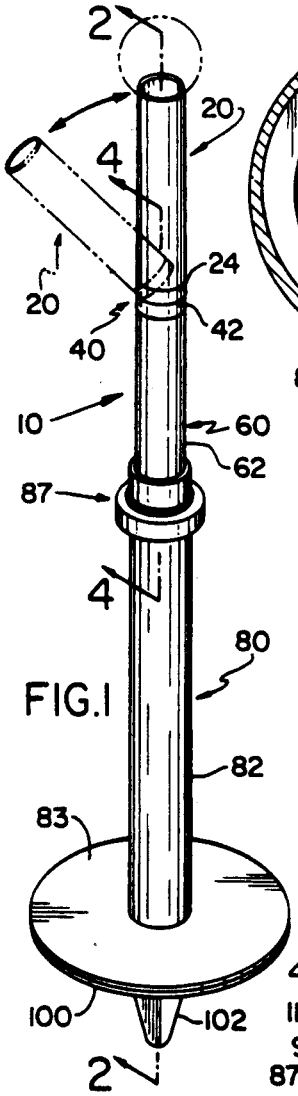
FIG. 1 is an isometric view of the T-ball stand.

Referring now to the drawings, the baseball or softball batting, hitting or T-ball stand of the present invention is indicated generally by the reference numeral 10 and is best seen in the overall in FIG. 1. The T-ball stand is comprised of a base member 80, a telescoping interconnecting member 60 coaxially and slidably associated with base member 80, a ball support seat member 40 removably associated with interconnecting member 60 and a ball support member 20. Ball support member 20 is pivotably connected to interconnecting member 60 by means of cord 30 and biasing means 65 connected thereto.

Figure 2:
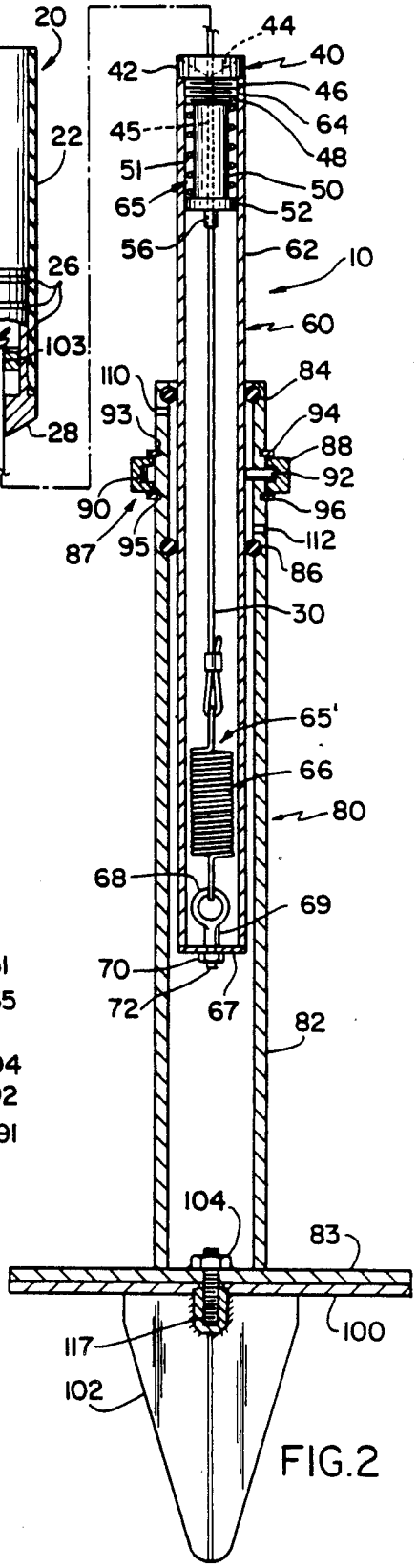
FIG. 2 is a cutaway view taken along lines 2—2 of FIG. 1.

In detail, as seen in FIG. 2, ball support member 20 is comprised of a resilient hollow tube-like member 22 sized and shaped to accomodate a ball placed thereupon for hitting. Member 22 may be suitable for supporting a baseball, softball, whiffleball, etc., but is preferably suited for a baseball (shown in phantom in FIG. 1). Ball support member 22 is rigidly connected to ball support member core 24, preferably by means of a series of barb-like ribs 26 circumferentially disposed on core 24. Core 24 is generally cylindrical having at least a portion of its internal surface threaded, and further having a conically shaped solid lower end portion 28 with a vertical bore 29 therethrough through which a fastening cord 30 passes. Cord 30 connects fixedly to member 24 by fastening means 31 which may be, for instance, a knot tied in cord 30, cord 30 being disposed through aperture 103 in adjusting nut 108 which is threadingly engaged in threads 105, disposed within the interior recess of core 24. Aperture 103 within nut 108 is of a lesser diameter than fastening means 31 so that said fastening means 31 cannot be pulled through aperture 103. Nut 108 has diametrically arranged slot 109 on its upper surface to accomodate a bifurcated cord tension adjusting tool 107 which is made to be longer than tube 22 so that a user can extend tool 107 vertically into tube 22 and place the furcations of tool 107 one into each of slots 109. Rotation of tool 107 about its elongate axis will cause nut 108 to rotate accordingly up or down depending upon the direction of rotation of tool 107. In this way, if nut 108 moves upwardly, any slack will be taken up in cord 30, cord 30 will be stretched and biasing means 65 will be compressed, resulting in an increase in the potential energy of the cord 30/means 65 arrangement. This increase in energy will cause upper member 20 to be brought from its separable, leaning, or broken away position, shown in phantom in FIG. 1, to the upright position of FIG. 1 at increased speed. Thus it can be seen that by adjusting nut 108 up or down the return rate of ball support member 20 can be easily adjusted by the user without having to disassemble the device.

A ball support core seat 42 is removably connected to interconnecting member sleeve 62, such as by means of inner threads 64 on sleeve 62 mating with outer threads 46 on seat 42. Upper seat surface 44 has the inverse shape to that of surface 28 of ball rest core 24 so that when the ball support 20 is placed upon the ball support seat 40 surfaces 28 and 44 mate in facial association. A vertical bore 45 is disposed in member 42 which is in vertical registry with and sized generally the same as bore 29 for placement of cord 30 therethrough. The lower portion 48 of ball support seat member 42 is connected to a generally cylindrical elongated shock dispersion or member 50 which is of preferably a solid open cell foam material and has a circular bore through its center coincident with bores 29, 45 and 103 for receiving cord 30 therethrough.

Figure 4:
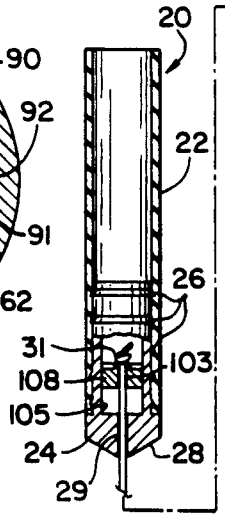
FIG. 4 is an enlarged partial sectional view of the invention, along lines 4—4 of FIG. 1.
Figure 4:
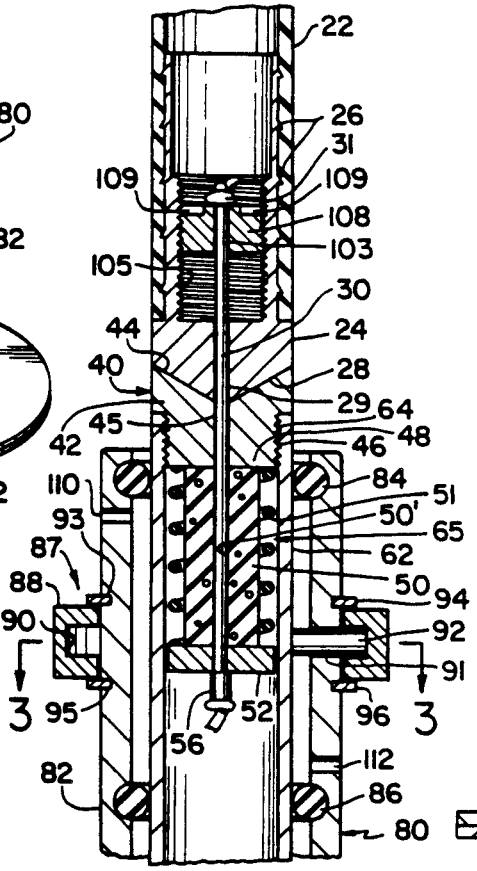

As best seen in FIG. 4, or member 50 is surrounded by compression spring 51, the upper end thereof operably contacting the lower end of seat 42 and the lower end thereof contacting an annular washer-like member 52 disposed in vertical coaxial registry below and with or member 50 having a bore through which cord 30 passes. Said washer-like member 52 is held against even the slightest downward vertical movement relative to cord 30 by fastening means 56, which may be, for example, a knot tied in cord 30 immediately below washer-like member 52. Cord 30 is therefore fixed relative to member 52.

Interconnecting member 60 is comprised of an elongated hollow cylindrical sleeve 62 of length comparable to base member tube 82. The outside diameter of sleeve 62 should be slightly less than the inside diameter of base member tube 82. For example, but not by way of limitation, sleeve 62 has an outside diameter of 1 5/16" and has a smooth outer surface, and base member tube 82 has an inside diameter of 1 11/16". A pair of O-rings 84 and 86, preferably rubber, may be positioned horizontally on the inside surface of base member tube 82 preferably housed partly within recesses disposed in said base member tube 82 so that the amount of O-ring material exposed beyond said recesses is approximately equal to the radial distance between the outer surface of sleeve 62 and the inner surface of base member tube 82. Among the beneficial features of using said pair of O-rings are that: interconnecting member 60 is easily, smoothly and uniformly slidable within base member 80 in that said O-rings 84 and 86 act as sliding guide bushings; sleeve 62 will not vibrate within base member 80 due to the damping feature of said O-rings, thereby effectively increasing the useful life of the invention; to provide a stabilization means against which sleeve 62 may be forced when the height adjustment twist lock mechanism (infra) 87 is tightened; and to provide a reservoir for a dry lubricant, defined by the upper O-ring 84, lower O-ring 86, inner surface of tube 82 and outer surface of sleeve 62. Inlet and outlet apertures 110 and 112, respectively, may be employed for introducing a dry lubricant into said dry lubricant reservoir.

Seat member 40 is comprised, as shown in FIG. 4, of member 42 operably connected to a biasing means arrangement 65 for decelerating member 20 after member 20 is struck by a bat, and thereafter returning member 20 to its vertical, at rest position. A washer like member 52 is rigidly connected to cord 30 using connecting means 56 at a point immediately below member 50. A helical spring 51 surrounds member 50 and is generally of the same length. Member 52 operably contacts the lower ends of spring 51 and member 50. When cord 30 is pulled upwardly, spring 51 and bushing 50 compress, thereby decelerating member 20, and ultimately returning said member to vertical. Cord 30 may be of a resilient material to enhance the spring like behavior of biasing means 65.

Cord 30 is connected rigidly to ball support core 24, as described earlier, and the remaining length thereof is disposed through bore 29 in ball support core 24, bore 45 in ball support core seat 42, bore 50' in shock dispersion member 50 and then through washer-like, or abutment member 52, which should have an outside diameter slightly less than the inside diameter of interconnecting sleeve 62 and is slidable therewithin. Cord 30 may be rigidly connected to a second biasing means 65', which may be a tension spring 66 and in turn is rigidly connected to an anchoring means 67 at the base of sleeve 62, which is preferably comprised of an anchor bolt having an eye portion 68, a threaded stud 72 and a nut 70. It can readily be seen that, in the embodiment of FIG. 2, the ball support core 24 is rigidly connected to both the ball support 22 and cord 30, and therefore if support 22 is urged upward, cord 30 would as well be pulled upward causing spring 66 to expand from its equilibrium at-rest position. If the first biasing means is also used, spring 51 would be compressed along with member 50, tending to decelerate the tipping motion of member 22, bringing it to rest, and quickly returning it to its vertical ball supporting position. Once spring 66 is expanded, its natural tendency is to return itself to equilibrium, and that re-action also pulls cord 30 and ball support member 20 back to its vertical detachable position atop interconnecting member 40 It can also be seen that if member 20 is pivoted about the interconnection of elements 24 and 42, cord 30 and spring 66 will be pulled upward, and spring 51 and bushing 50 compressed, all counteracting the tipping movement of member 20. Once member 20 is released, spring 66 will once again return member 20 to its vertical, at-rest position.

It should be noted that said biasing means 65 and 65' should have a spring constant sufficiently great to return member 20 to its vertical position quickly. It should also be noted that cord 30 may be provided with a safety cable means (not shown), preferably in the form of a monofilament strand of fiber having high tensile strength, preferably on the order of 100 lb. yield strength. Said safety cable means should be positioned internal to said cord and generally parallel thereto, but provided with slack so that said safety cable means will remain inactive and unstressed until and unless the eventuality occurred where cord 30 breaks.

In use, a ball is placed atop ball support sleeve 22 and struck with a bat. Forces transferred to sleeve 22 are dissipated in part by the intrinsic resiliency of sleeve 22 and by pivoting movement of said member 20, which hereby causes cord 30 to be pulled rapidly and vigorously upward thereby compressing biasing means 65 and expanding biasing means 65'. The aforementioned upward movement of cord 30 causes fastening means 56 to urge washer-like member 52 into firm abutting contact with spring 51 and member 50 which, as previously described, is resilient. The above mentioned combination of bushing 50, biasing 65 and 65' and O-rings 84 and 86 are responsible for damping out vibrations, a feature which can be more fully appreciated when one considers the magnitude of force involved when a baseball bat is swung at high speed and strikes member 20. Cord 30 preferably has elastic properties to provide further damping. The above-mentioned resilient elements coact to make the instant invention durable, safe and long-lasting. It should be noted that member 20 should be free to pivot in all directions (i.e.: 180° to its upright position).

Figure 3:
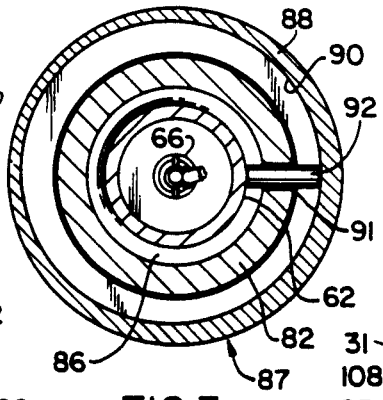
FIG. 3 is an enlarged partial sectional view of the invention, along lines 3—3 of FIG. 4.

Height adjustment means are provided in the form of a circular twist ring 88 having an inside diameter slightly larger than the outside diameter of base member tube 82, as best seen in FIGS. 1 and 2, coacting with a short, preferably cylindrical, Delrin tab 92 disposed through a transverse (radial) aperture in base member 82 at a point between upper and lower O-rings 84 and 86. Ring 88 has an eccentric groove 90 notched around its inner surface, as seen in FIG. 3, its width being slightly greater than the diameter of tab 92. A radial bore 91 is provided in the wall of base tube 82 to support and guide Delrin tab 92. One end of tab 92 is disposed within groove 90 and the other end positioned for engagement against the inside surface of connecting sleeve 62. A turn of ring 88 relative to tube 82 causes eccentric groove 90 to act as a cam, urging tab 92 into engagement with sleeve 62 as the distance between groove 90 and the inside surface of ring 88 is decreased by turning motion of ring 88 in either direction. In this way, ring 88 can be turned to loosen tab 92, sleeve 62 can be slid up or down to adjust the height of ball support 20 and ring 88 thereafter turned until tab 92 firmly engages the outer surface of sleeve 62 thereby forcing said sleeve 62 to push rearwardly against the O-rings 84 and 86 so that relative movement between sleeve 62 and tube 82 is prevented. To stabilize ring 88, upper snap ring 94 and lower snap ring 96 are fitted in respective annular grooves 93 and 95 of tube 82.

Figure 7:
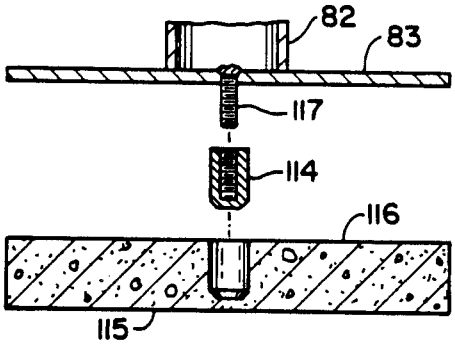
FIG. 7 is a side elevation of a ground support for the present invention.
Figure 8:
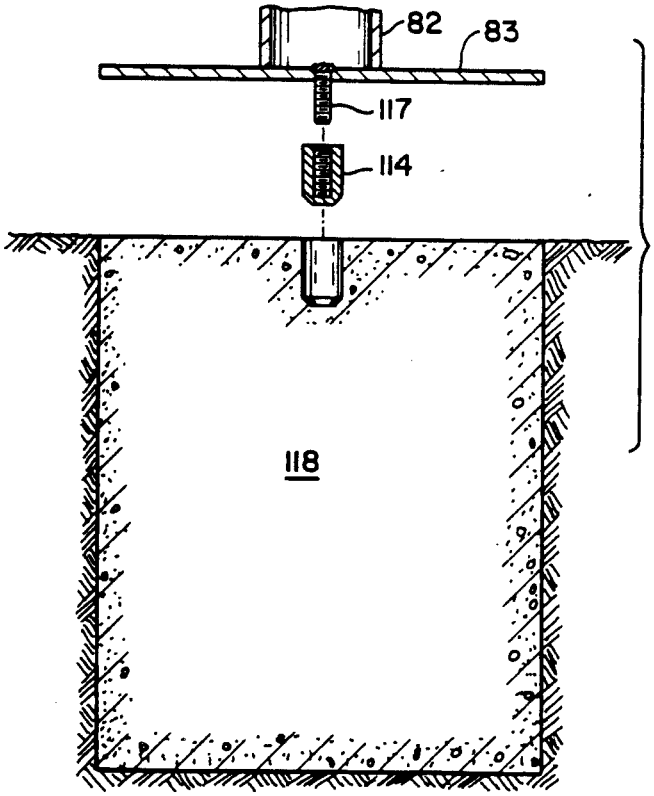
FIG. 8 is another embodiment of a ground support for the present invention.

Removable ground piercing means may be provided for engaging the T-ball stand into the ground for use out of doors. Said ground piercing means may be comprised of ground piercing member 102 threadingly engaged upon stud 117, and said stud may be welded onto base flange 83 of base 80 or screwed thereto using nut 104, which may be welded to base flange 83. Said ground piercing means 102 may be provided with internally threaded female member 106 adapted to receive stud 117. Said member 102 may be removed and stud 117 covered with a base fitting dowel adapter 114 of FIGS. 7 or 8, said base fitting 114 thereafter acting as a dowel-type member for insertion into a comparatively sized recess in a support mat for indoor use, a movable weighted ground plate 116 of FIG. 7 or a permanent ground fixture 118 of FIG. 8.

In addition, means may be provided for employing more than one T-ball stand of the instant invention simultaneously. To this end, a support mat, whether for indoor or outdoor use, may be provided having a plurality of means for receiving said T-ball stands. In this way, said T-ball stands may be positioned at various locations relative to a batters' box, allowing a batter to obtain the equivalent conditions of outside, center, and inside pitches as well as early and late swing results for practicing pulling and pushing a ball to the "opposite field".

Figure 5:
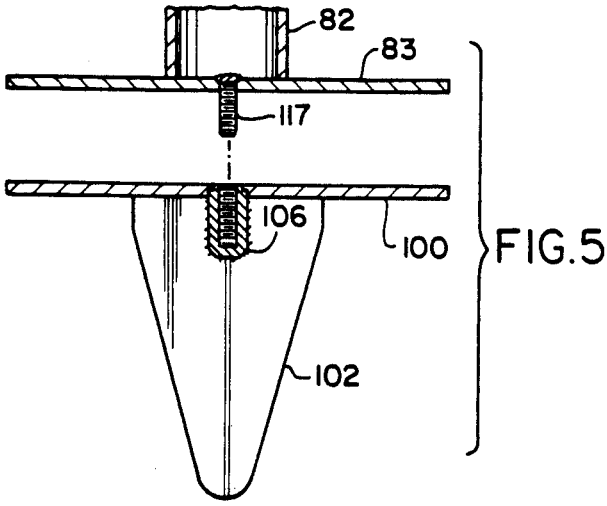
FIG. 5 is a partial view similar to FIG. 2 showing an alternate base means.
Figure 6:
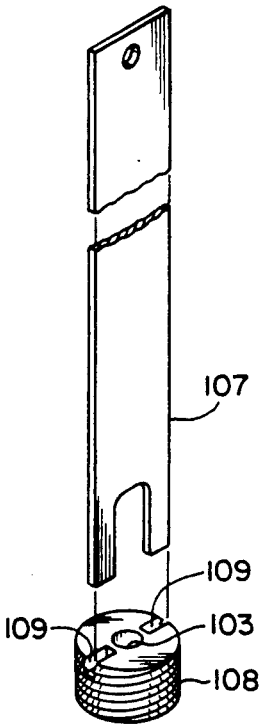
FIG. 6 is an isometric detail of nut and adjusting tool as seen in remote spaced relation for clarity.

Fixed to the lower end of base sleeve 82 is a base flange member 83 to which nut 104 is welded or otherwise fastened, or to which stud 117 is welded, as shown in FIG. 5.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A batting tee, comprising:

a base member comprised of a ground engaging member adjustably supporting an intermediate member, said intermediate member having an upper end and a lower end;

a ball support return means connected to an upper end of said intermediate member;

a ball support member releasably connected to said ball support return means;

a flexible cable means releasably connecting said ball support member to said ball support return means;

said ball support member having a normally vertical at rest orientation;

wherein said ball support return means is comprised of a resilient shock absorbing member for dissipating movement of said cable means, wherein when a bat strikes and tips over said ball support member, restoring forces within said ball support return means urge said ball support member to return to its vertical, at rest position.

2. The batting tee of claim 1, wherein:

said batting tee is at least 15 inches in vertical height.

3. A batting stand comprising:

a support means including a post having a base and an interconnecting member, said interconnecting member having an upper end portion and a lower end portion;

a break-away ball support member releasably connected to the upper end portion of said interconnecting member;

a return means connected between the upper end portion of said interconnecting member and said break-away ball support member;

said return means including a biasing means for storing energy;

said interconnecting member and said break-away ball support member being pivotally interconnected, said ball support member being pivotable between at least two different positions relative to said interconnecting member, a first, ball supporting, position and at least a second, tipped over, position;

said return means urging said ball support member into said first ball supporting position after said ball support member is moved into said tipped over position;

said return means is comprised of a generally vertically disposed return spring having an upper end and a lower end, the upper end of said return spring being connected rigidly to said interconnecting member, the lower end of said return spring being connected to a flexible cord means, said cord means being operatively connected between said lower end of said return spring and the upper end portion of said break-away ball support member, said return spring being compressed by linear vertical upward movement of the flexible cord means during the tipping of said ball support member such that the natural restoring force of said return spring urges said ball support member to return to the ball supporting position.

4. The T-ball stand of claim 3, wherein said ball support member is comprised of:

an elongated cylindrical resilient sleeve member sized and shaped to support a ball when said sleeve is oriented vertically;

a ball support core connected to said return means and rigidly connected to said sleeve member.

5. A T-ball stand, comprising:

a support means including a base having a post and an interconnecting member telescopingly slidingly disposed therein, said interconnecting member having a top portion and a bottom portion;

a break-away ball support member connected to the top portion of said interconnecting member;

a return means connected between said interconnecting member and said break-away ball support member;

said stand further including adjusting means for releasably securing said interconnecting member relative to said post;

wherein said post is a cylindrical member having an inside and an outside surface, and wherein said adjusting means is comprised of:

a circular ring having internal and external surfaces disposed around a portion of the outside surface of said post, said post comprising a contiguous elongated cylinder having a relatively small aperture disposed transversely therethrough at generally the same point where said ring is associated with said post;

an eccentric circular groove disposed along the entire internal surface of said ring, said groove having a rotational center eccentric to the rotational center of said ring;

a short cylindrical pin means for mating engagement between said groove and said interconnecting member, said pin being positioned generally within said aperture.

6. The T-ball stand of claim 5, wherein said return means is comprised of:

a shock absorbing member;

a helical compression spring adapted for operable coaction with said member, said helical compression spring generally surrounding said shock absorbing member in coaxial relation;

said ball support member pivotable between a first ball support position and a second tipped over position;

cable means for transferring movement of said ball support member into movement of said return means whereby when said ball support member moves from said first, ball support, position toward said second, tipped over, position, said cable means causing compression of said helical compression spring and said shock absorbing member generally simultaneously by virtue of mechanical interconnection between said cable means and said helical compression spring and said shock absorbing member;

said movement of said return means acting to decelerate movement of said ball support member until said ball support member comes to rest, said return means thereafter returning said ball support member to the first ball support position.

7. The T-ball stand of claim 6, wherein:

said cable means for transferring movement is a flexible nylon cord having an upper end connected to said ball support member and having a lower end operably connected to said compression spring and to said shock absorbing member;

wherein tipping movement of said ball support member causes said cord to move upward, thereby causing compression of said bushing and of said compression spring after which the restoring force of said compression spring and bushing return said ball support member to its ball support position.

8. The T-ball stand of claim 7:

wherein said ball support member is comprised of:

an elongated cylindrical resilient sleeve member sized and shaped to support a baseball when said sleeve is oriented vertically;

a ball support core connected to said return means and rigidly connected to said sleeve member.

9. The T-ball stand of claim 7, wherein said return means is comprised of:

a generally cylindrical shock absorbing member having an upper end and a lower end;

a helical compression spring adapted for operable coaction with said shock absorbing member, said helical compression spring having an upper end and a lower end generally corresponding with the upper and lower ends, respectfully, of shock absorbing member, said spring being coaxially disposed about said shock absorbing member;

said ball support member pivotable between a first ball support position and a second tipped over position;

cable means for transferring movement of said ball support member into movement of said return means, said cable means being fixedly connected to an annular disc member, said disc member positioned generally below and in contact with the lower ends of said shock absorbing member and of said compression spring and being operatively associated therewith, whereby when said ball support member moves from said first, ball support, position toward said second, tipped over, position, said cable means pulls upwardly against said disc member, causing said disc member to move upwardly into compressing engagement with said helical spring and said shock absorbing member causing compression of said helical compression spring and said shock absorbing member generally simultaneously;

said movement of said return means acting to decelerate movement of said ball support member until said ball support member comes to rest, said return means thereafter returning said ball support member to the first ball supporting position.

10. A T-ball stand, comprised of:

a support means including a post having a base and an interconnecting member, said interconnecting member having a top portion and a bottom portion;

a break-away ball support member releasably connected to the top portion of said interconnecting member;

a return means connected between the top portion of said interconnecting member and said break-away ball support member;

said return means including a biasing means for storing energy;

said interconnecting member and said break-away ball support member being pivotally interconnected, said ball support member being pivotal between at least two different positions relative to said interconnecting member, a first, ball supporting, position and at least a second, tipped over, position;

said return means urging said ball support member into said first ball supporting position after said ball support member is moved into said tipped over position;

wherein said return means is comprised of:

a generally cylindrical shock absorbing member having an upper end and a lower end;

a helical compression spring in operable coaction with said shock absorbing member, said helical compression spring having an upper end and a lower end generally corresponding with the upper and lower ends, respectfully, of said shock absorbing member, said spring being coaxially disposed about said shock absorbing member;

cable means for transferring movement of said ball support member into movement of said return means, said cable means being fixedly connected to an annular disc member, said disc member positioned generally below and in contact with the lower ends of said shock absorbing member and of said compression spring, whereby when said ball support member moves from said first, ball support, position toward said second, tipped over, position, said cable means pulls upwardly against said disc member, causing said disc member to move upwardly into compressing engagement with said helical spring and said shock absorbing member, causing compression of said helical compression spring and said shock absorbing member generally simultaneously;

said movement of said return means acting to decelerate movement of said ball support member until said ball support member comes to rest, said return means thereafter returning said ball support member to the first ball supporting position.

11. An improved batting tee, comprising:

a resilient ball rest portion;

a ball rest seat portion disposed generally below said ball rest portion;

ball rest portion return means operably connected to said batting tee generally below said ball rest seat portion;

interconnecting means having a first end and a second end, the first end of said interconnecting means being connected to said ball rest portion, the second end of said interconnecting means being connected to said ball rest portion return means;

said ball rest seat portion being connected to said ball rest portion;

said ball rest portion return means acting to maintain said ball rest portion in an upright position but yielding slightly upon impact by a hitting means thereby causing said ball rest portion to tip and thereafter be urged back into the upright position by said ball rest portion return means;

wherein said ball rest portion return means is comprised of a pair of compression springs disposed concentrically one about the other in coaxial relation, said compression springs each having an upper end and a lower end, the upper end of each said compression spring being in abutting relationship with said ball rest seat portion, the lower end of each said compression spring being connected to said ball rest portion via a flexible cord.

* * * * *